US006290169B1

(12) United States Patent
Hartley

(10) Patent No.: US 6,290,169 B1
(45) Date of Patent: Sep. 18, 2001

(54) FREE STANDING PAPER TOWEL DISPENSING APPARATUS

(76) Inventor: Linda Sue Hartley, 273 Prospect Dr., Brick, NJ (US) 08724

( * ) Notice: Subject to any disclaimer, the term of this patent is extended or adjusted under 35 U.S.C. 154(b) by 0 days.

(21) Appl. No.: 09/597,708

(22) Filed: Jun. 13, 2000

(51) Int. Cl.[7] ..... B65H 49/00

(52) U.S. Cl. ..... 242/588.6; 242/597.7; 242/598.3; 242/598.5; 242/610.2

(58) Field of Search ..... 242/588, 588.3, 242/588.6, 597, 597.1, 597.4, 597.7, 597.8, 598.3, 598.5, 598.6, 599.4, 596.7, 610.2, 130.2; D6/521, 522, 523

(56) References Cited

U.S. PATENT DOCUMENTS

| | | | | |
|---|---|---|---|---|
| D. 248,069 | * | 6/1978 | Robles | D6/521 |
| D. 415,379 | * | 10/1999 | Tisdale | D6/522 |
| D. 422,170 | * | 4/2000 | Harris, Jr. | D6/521 |
| 686,324 | * | 11/1901 | McKay | 242/588.6 |
| 1,127,053 | * | 2/1915 | MacDonald | 242/588.6 |
| 2,633,396 | | 3/1953 | Kawecki | 312/39 |
| 3,228,519 | * | 1/1966 | Dong et al. | 242/596.7 X |
| 3,237,827 | | 3/1966 | Domenico et al. | 225/42 |
| 3,597,032 | | 8/1971 | Harangozo | 312/39 |
| 3,843,071 | * | 10/1974 | Graham | 242/588.6 |
| 3,870,212 | | 3/1975 | Polk | 225/42 |
| 4,030,676 | * | 6/1977 | Bardsley | 242/597.7 |
| 4,615,442 | * | 10/1986 | Beeken | 242/598.6 X |
| 4,821,876 | * | 4/1989 | Naito et al. | 242/598.6 |
| 4,842,211 | * | 6/1989 | Robbins | 242/588.3 |
| 4,848,690 | * | 7/1989 | Lemoine . | |
| 4,936,452 | * | 6/1990 | Pauley | 242/588.6 |
| 5,598,987 | * | 2/1997 | Wachowicz | 242/597.8 |
| 5,715,971 | | 2/1998 | Morand | 22/45 |
| 5,769,354 | * | 6/1998 | Lindh et al. | 242/597.1 X |
| 6,161,796 | * | 12/2000 | Daniels | 242/597.7 |

* cited by examiner

*Primary Examiner*—William A. Rivera
(74) *Attorney, Agent, or Firm*—Henderson & Sturm LLP

(57) ABSTRACT

A free standing paper towel dispensing apparatus (10) including a free standing support unit (11) having a generally rectangular base member (20) provided with a rectangular shaped central recess (21) which has a centrally disposed elongated support post element (23) that is dimensioned to be received in the cardboard tube (102) core of the roll of paper towels. A decorative cover unit (12) is dimensioned to receive a roll of paper towels (100) and includes an elongated dispensing container member (30) having an elongated dispensing slot (37), a closed upper end (31) and a lower end (32) provided with a stiffening block element (34) and a central aperture (33') dimensioned to receive the support post element (23). The stiffening block element (34) prevents the movement of the lower end (32) of the dispensing container member (30) relative to the recess (21) in the base member (20), as well as retards the rotational movement of the roll of paper towels (100) within the dispensing container member (30).

11 Claims, 2 Drawing Sheets

FREE STANDING PAPER TOWEL DISPENSING APPARATUS

BACKGROUND OF THE INVENTION

1. Field of the Invention

The present invention relates to the field of paper towel dispensing apparatus in general, and in particular to a free standing dispensing apparatus having a decorative container component.

2. Description of Related Art

As can be seen by reference to the following U.S. Pat. Nos. 2,633,396; 3,237,827; 3,597,032; 3,870,212; and 5,715,971, the prior art is replete with myriad and diverse paper towel dispensing arrangements.

While all of the aforementioned prior art constructions are more than adequate for the basic purpose and function for which they have been specifically designed, they are uniformly deficient with respect to their failure to provide a simple, efficient, and practical free standing paper towel dispensing device that employs a decorative paper towel container cover. The actual function of the paper towel dispensing arrangement will not be readily apparent at first glance.

As most people are aware, a paper towel dispenser is a necessary accessory in virtually every kitchen and bathroom. However, many people wish that there was a more convenient way for the paper towel dispenser to be less visibly intrusive, yet always readily accessible.

As a consequence of the foregoing situation, there has existed a longstanding need for a new and improved type of free standing paper towel dispensing arrangement which is not only readily movable about the home to a location where most needed, but also an arrangement whose purpose and function is not readily apparent, and the provision of such a construction is a stated objective of the present invention.

BRIEF SUMMARY OF THE INVENTION

Briefly stated, the free standing paper towel dispensing apparatus that forms the basis of the present invention comprises in general, a free standing support unit adapted to rotatably receive a roll of paper towels and a decorative cover unit that is dimensioned to receive a roll of paper towels mounted on the support unit.

As will be explained in greater detail further on in the specification, the support unit includes a moveable base member provided with central recess forming a raised peripheral lip and a centrally disposed vertical support post element. The post element is dimensioned to be received in the hollow central core of a roll of paper towels and form an axis of rotation thereof.

In addition, the decorative cover unit includes a generally elongated rectangular dispenser container member having a closed upper end and a lower end having a central aperture that is dimensioned to receive the vertical support post element. The exterior surface of the cover member is intended to be color coordinated with other generally fixed kitchen accessories and appliances, as well as bathroom accessories.

Furthermore, the lower end of the dispenser container member is provided with a stiffening block element that will prevent the rotational movement of the decorative cover unit relative to the free standing support unit, as well as retard the rotational movement of the roll of paper towels within the decorative cover unit as the sheets of paper towels are withdrawn from a dispensing slot formed in the decorative cover unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
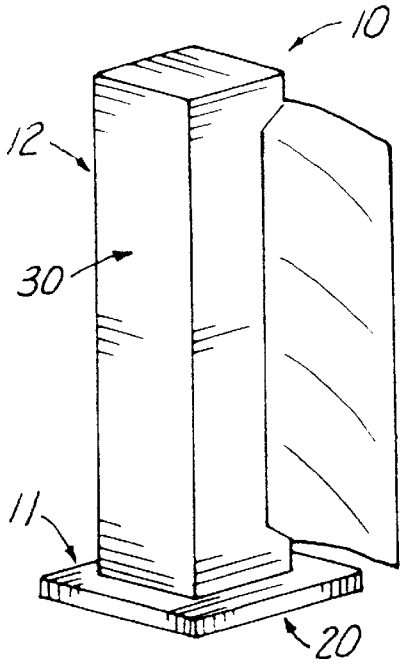
FIG. 1 is a perspective view of the free standing paper towel dispensing apparatus that forms the basis of this invention.

As can be seen by reference to the drawings, and in particular to FIG. 1, the free standing paper towel dispensing apparatus that forms the basis of the present invention is designated generally by the reference number 10. The apparatus 10 comprises in general, a free standing support unit 11, and a decorative cover unit 12. These units will now be described in seriatim fashion.

Figure 2:
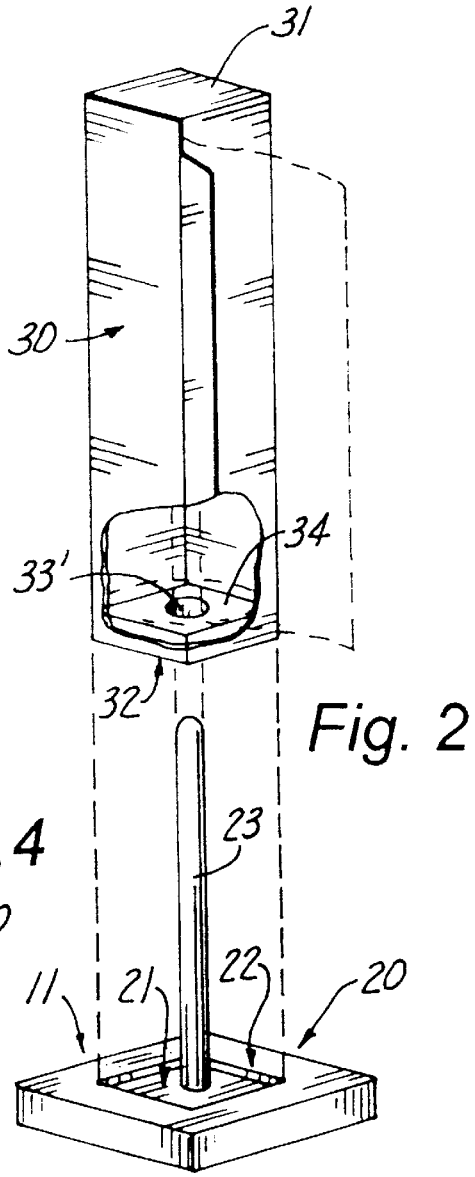
FIG. 2 is an exploded perspective view of the paper towel dispensing apparatus.

As can best be seen by reference to FIG. 2, the free standing support unit 11 comprises a generally flat rectangular base member 20 provided with a generally square recess 21 that creates a raised peripheral lip 22 on the top surface of the base member 20.

In addition, the generally square recess 21 is further provided with a centrally disposed elongated support post element 23. The purpose and function of the recess 21, the peripheral lip 22, and the support post element 23 will be explained in greater detail further on in the specification.

As shown in FIGS. 1 through 4, the decorative cover unit 12 comprises an elongated rectangular dispenser container member 30 having a closed upper end 31 and an apertured lower end 32 provided with a centrally disposed aperture 33 that is dimensioned to receive the support post element 23 of the support unit 11.

Figure 3:
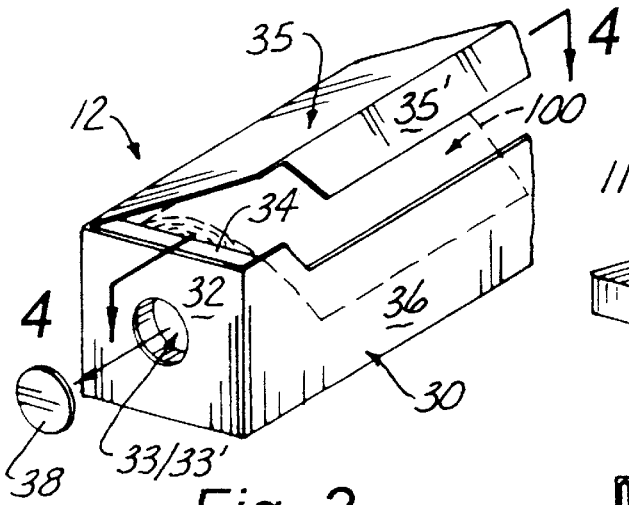
FIG. 3 is an isolated perspective view of the lower end of the dispenser container member.
Figure 4:
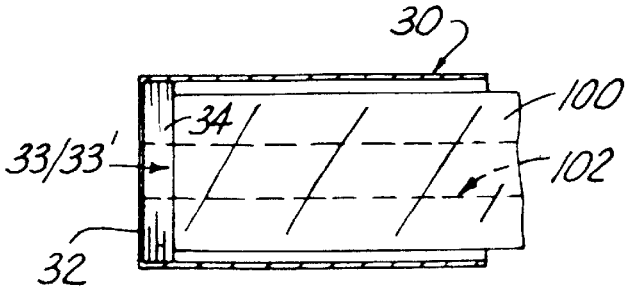
FIG. 4 is a cross sectional view taken through line 4—4 of FIG. 3.

As can best be seen by reference to FIGS. 2 through 4, the lower end 32 of the dispenser container member 30 is also provided with a generally square stiffening block 34 which is also provided with a central aperture 33' that is aligned with the central aperture 33 in the lower end 32 of the dispenser container member 30. The stiffening block 34 serves the dual function of providing structural rigidity to the lower end 32 of the dispenser container member 30 when the lower end 32 of the dispenser container member 30 is received within the central recess 21 of the base member 20. The upper surface of the stiffening block 34 provides a friction surface that will engage the bottom surface of a roll of paper towels 100 and retard the rotation of the roll of paper towels 100 during the dispensing process.

Figure 5:
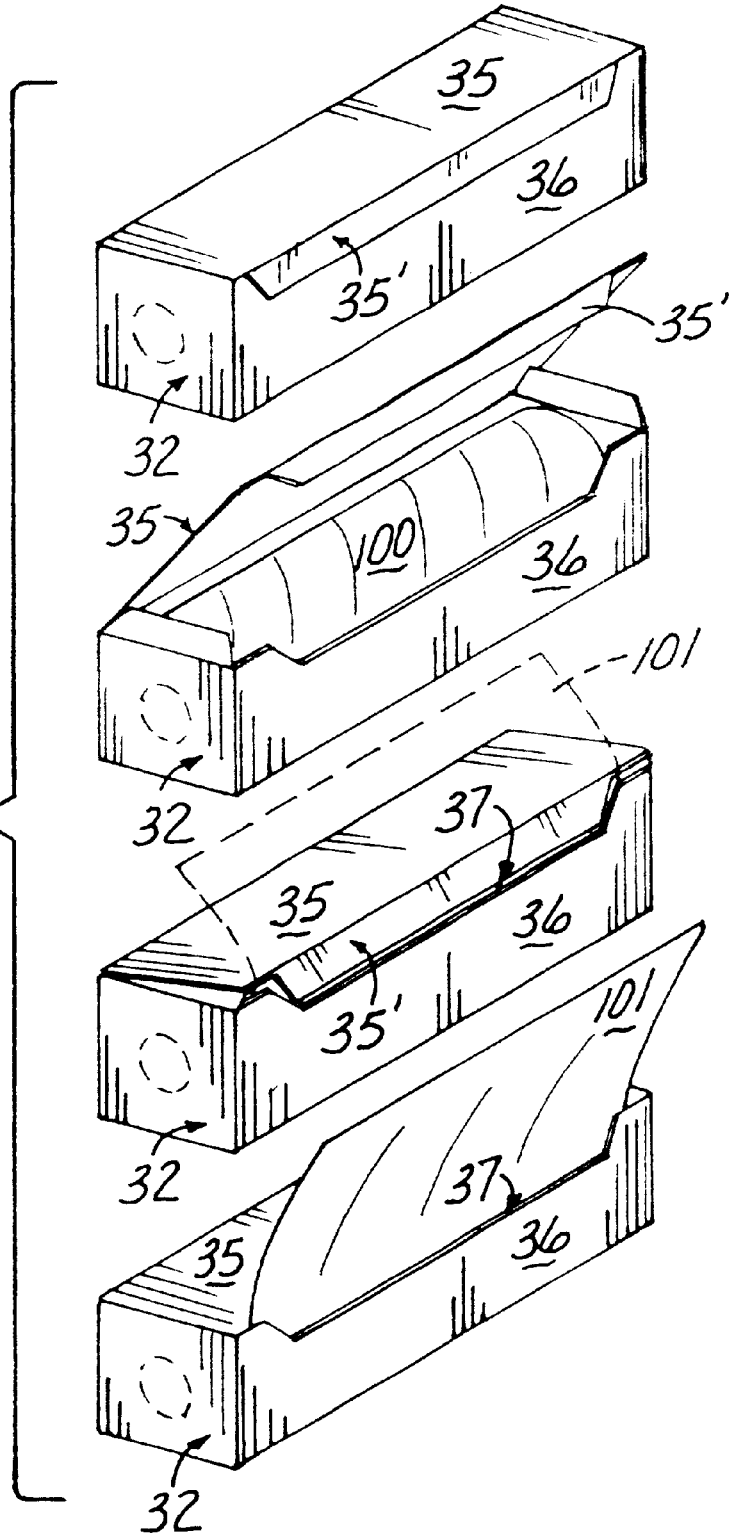
FIG. 5 is a sequential view of the steps involved in loading a roll of paper towels in the dispenser container member.

As can best be appreciated by reference to FIGS. 3 and 5, one of the elongated sides of the dispensing container member 30 comprises a hinged lid element 35 whose free end cooperates with the adjacent side panel 36 of the dispensing container member 30 to define an elongated dispensing slot 37.

In addition, in the preferred embodiment of the invention, the free end of the lid element 35 comprises a flexible tab 35'. However, it is to be understood that any dispensing container configuration having a hinged lid element 35 that allows a roll of paper towels 100 to be deposited into the interior of the dispenser container member 30, wherein one of the elongated sides of the dispenser container member 30 is provided with a dispensing slot 37 dimensioned to permit the passage of the single sheets 101 that comprise the roll of paper towels 100 would be acceptable as well.

Returning once more to FIG. 3, it can be seen that this invention also contemplates the use of a cover plug element 38 that can be inserted into the central aperture 33 in the lower end 32 of the dispenser container member 30 for reasons that will be explained presently.

In the preferred mode of operation, a roll of paper towels 100 would be inserted into the interior of the container dispenser member 30 which would then be lowered onto the support post element 23 in a well recognized manner such that the support post element 23 would fit inside the cardboard tube 102 in the interior of the roll of paper towels 100.

Once the lower end 32 of the container dispenser member 30 is received in the central recess 21 of the base member 20, the surrounding raised peripheral lips 22 will prevent the container dispenser member 30 from rotating relative to the base member 20. The upper frictional surface of the stiffening block. 34 will also afford frictional resistance to the rotation of the roll of paper towels 100 which will further be frictionally retarded by the contact of the inner surface of the cardboard tube 102 of the paper towel roll 100 with the support post element 23 in a well recognized manner.

By now it should be appreciated that while the roll of paper towel can be employed independently with either the free standing support unit 11, or the decorative cover unit 12 in the preferred embodiment of this invention, both of these units are designed and intended to be used in combination with one another. The decorative cover unit 12 is intended to be provided in a variety of decorative colors that match the color scheme of a given kitchen such that the function and purpose of the apparatus 10 is not readily apparent.

Along those same lines as shown in FIG. 3, when the decorative cover unit 12 is employed independently of the free standing support unit 11, the cover plug element 38 would be employed to seal the aperture 33 so that the contents of the container dispenser member 30 would not be readily visible to a casual observer.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A free standing paper towel dispensing apparatus for use with a roll of paper towels having a central cardboard tube wherein the apparatus comprises:

a decorative cover unit including an elongated rectangular dispenser container member having a lower end, a closed upper end, and a plurality of elongated rectangular side panels that define an interior compartment dimensioned to receive a roll of paper towels and further including an elongated dispensing slot that is dimensioned to allow the passage of single sheets of paper towels that comprise the roll of paper towels; and a free standing support unit including a generally rectangular base member provided with a central recess dimensioned to receive the lower end of the dispenser container member wherein the central recess in the base member is further provided with an elongated support post element that is dimensioned to be received within the central cardboard tube of the roll of paper towels and the lower end of the container dispenser member is provided with a central aperture dimensioned to receive the elongated support post element; and wherein the container dispenser member further includes a stiffening block element disposed in the lower end of the container dispenser member wherein the stiffening block element is further provided with a central aperture dimensioned to receive the elongated support post element.

2. The apparatus as in claim 1 wherein one of the elongated rectangular side panels that forms the container dispenser member comprises a hinged lid element.

3. The apparatus as in claim 2 wherein the hinged lid element has a free end provided with a flexible tab.

4. The apparatus as in claim 3 wherein said flexible tab and one of the other elongated rectangular side panels defines said elongated dispensing slot.

5. A free standing paper towel dispensing apparatus for use with a roll of paper towels having a central cardboard tube wherein the apparatus comprises:

a decorative cover unit including an elongated rectangular dispenser container member having a lower end, an upper end, and a plurality of elongated rectangular side panels that define an interior compartment dimensioned to receive a roll of paper towels wherein one of the elongated rectangular side panels that forms the container dispenser member comprises a hinged lid element and further including an elongated dispensing slot that is dimensioned to allow the passage of single sheets of paper towels that comprised the roll of paper towels; and a free standing support unit including a generally rectangular base member provided with a central recess dimensioned to receive the lower end of the dispenser container member.

6. The apparatus as in claim 5 wherein the upper end of the dispenser container member is closed.

7. The apparatus as in claim 6 wherein the central recess in the base member is further provided with an elongated support post element that is dimensioned to receive the elongated support post element.

8. The apparatus as in claim 7 wherein the lower end of the container dispenser member is provided with a central aperture dimensioned to receive the elongated support post element.

9. The apparatus as in claim 8 wherein the container dispenser member further includes a stiffening block element disposed in the lower end of the container dispenser member wherein the stiffening block element is further provided with a central aperture dimensioned to receive the elongated support post element.

10. The apparatus as in claim 5 wherein said flexible tab and one of the other elongated rectangular side panels defines said elongated dispensing slot.

11. The apparatus as in claim 10 wherein said flexible tab and one of the other elongated rectangular side panels defines said elongated dispensing slot.

* * * * *